US005517203A

United States Patent [19]

Fiedziuszko

[11] Patent Number: 5,517,203

[45] Date of Patent: May 14, 1996

[54] DIELECTRIC RESONATOR FILTER WITH COUPLING RING AND ANTENNA SYSTEM FORMED THEREFROM

[75] Inventor: Slawomir J. Fiedziuszko, Palo Alto, Calif.

[73] Assignee: Space Systems/Loral, Inc., Palo Alto, Calif.

[21] Appl. No.: 240,909

[22] Filed: May 11, 1994

[51] Int. Cl.[6] ..... H01Q 15/24; H01P 1/208

[52] U.S. Cl. ..... 343/756; 343/776; 343/786; 333/202; 333/212; 333/219.1; 333/230

[58] Field of Search ..... 333/202, 208, 333/212, 219.1, 230; 343/756, 776, 786

[56] References Cited

U.S. PATENT DOCUMENTS

| | | | |
|---|---|---|---|
| 2,890,422 | 6/1959 | Schlicke | 333/219.1 |
| 4,489,293 | 12/1984 | Fiedziuszko | 333/202 |
| 4,498,061 | 2/1985 | Morz et al. | 333/212 X |
| 4,506,241 | 3/1985 | Makimoto et al. | 333/222 |
| 4,653,118 | 3/1987 | de Jong | 455/286 |
| 4,668,925 | 5/1987 | Towatari et al. | 333/219 |
| 4,890,118 | 12/1989 | Hudspeth et al. | 343/786 |
| 4,972,199 | 11/1990 | Raghavan et al. | 343/776 X |
| 5,027,090 | 6/1991 | Gueble et al. | 333/202 |
| 5,043,683 | 8/1991 | Howard | 343/756 X |
| 5,049,842 | 9/1991 | Ishikawa et al. | 333/235 |
| 5,352,997 | 10/1994 | Särkkä | 333/219.1 |

FOREIGN PATENT DOCUMENTS

| | | | |
|---|---|---|---|
| 81304 | 5/1983 | Japan | 333/219.1 |
| 1376141 | 2/1988 | U.S.S.R. | 333/208 |

*Primary Examiner*—Benny T. Lee
*Attorney, Agent, or Firm*—Perman & Green

[57] ABSTRACT

A plurality of dual mode, dielectric resonator loaded cavity filters may be coupled to respective ones of a plurality of radiators of an array antenna, such as a phased array antenna. Each of the filters is provided with a thin annular, electrically conductive ring disposed on a resonator surface facing the corresponding radiator of the antenna. The ring greatly increases the coupling of electromagnetic power for circularly and linearly polarized waves between the filter and the radiator for radiation of the power from the radiator into space, as well as during reception of radiation from outer space. The filter is operative also, if desired, to provide such coupling of electromagnetic power to a waveguide, as well as directly into the external environment. The ring may be located at the opening of the cavity through which the power is coupled between the filter and the radiator or the waveguide or the empty space.

29 Claims, 6 Drawing Sheets

DIELECTRIC RESONATOR FILTER WITH COUPLING RING AND ANTENNA SYSTEM FORMED THEREFROM

BACKGROUND OF THE INVENTION

This invention relates to dual mode, dielectric resonator, loaded cavity filters and, more particularly, to such filters adapted to radiate via horn radiators in a phased array antenna by provision of metallic annular rings directly on resonator surfaces facing the horn radiators.

Dielectric resonator filters constructed of a series of dielectric resonators enclosed within metallic cavities are employed in situations requiring reduced physical size and weight of the filters. One such situation of interest is in a satellite communication system wherein the filters are to be carried on board a satellite as a part of microwave circuitry of the communication system. The reduced size and weight of such a filter arise because the wavelength of an electromagnetic signal within a dielectric resonator is substantially smaller than the wavelength of the same electromagnetic signal in vacuum or in air. Coupling of electromagnetic power between contiguous cavities may be accomplished by means of slotted irises, as is disclosed in Fiedziuszko, U.S. Pat. No. 4,489,293. The aforementioned United States patent provides details in the construction of such a filter, and is incorporated herein by reference in its entirety. Such filters are capable of operation with circularly polarized electromagnetic signals, the circularly polarized signals being preferred in satellite communication systems. Such filters provide low-loss filtering, and avoid the disadvantage of excessive bulk of low-loss waveguide filters, the excessive bulk of waveguide filters rendering them incompatible with modern planar phased array systems. Furthermore, the dielectric resonator loaded cavity filters are preferred in satellite communication systems over planar stripline type filters because the stripline filters have unacceptably high losses for moderate and narrow bandwidths.

However, in spite of the foregoing advantages of the dielectric resonator filter, a problem arises in coupling signals from the filter to a radiating element of the antenna to attain a high flow of power with good coupling of the electromagnetic circularly polarized signal into the environment external to the radiating element. For example, existing antenna systems, such as those employing waveguide filters operative with circular polarization, accomplish the coupling of power with the aid of bulky components such as septum polarizers and other bulky components. Such use of excessively large and heavy microwave power-coupling circuitry would defeat much of the advantage of small size and weight of the dielectric resonator cavity filter. In particular, there is interest in the $HE_{11\Delta}$ hybrid mode wherein $\Delta$ may have any value from 0–1, and represents a portion of the half wavelength of an electromagnetic wave residing in a resonator spaced apart from an enclosing cavity wall. Aperture coupling of the dielectric resonator cavity filter operating in the $HE_{11\delta}$ hybrid mode to waveguides or to free space is a problem in that presently available microwave circuitry does not provide adequate coupling.

SUMMARY OF THE INVENTION

The aforementioned problems are overcome and other advantages are provided by use of a plurality of dual mode, dielectric resonator loaded cavity filters coupled to respective ones of a plurality of radiators of an array antenna, such as a phased array antenna. In accordance with the invention, each of the filters is provided with a thin annular, electrically conductive ring disposed on a resonator surface facing the corresponding radiator of the antenna, or spaced apart from the resonator surface by a disk of electrically insulating material having a dielectric constant significantly lower than the dielectric constant of the resonator. The ring greatly increases the coupling of electromagnetic power between the filter and the radiator for radiation of the power from the radiator into space, as well as during reception of radiation from outer space.

The invention enables coupling of electromagnetic signals directly from the dielectric resonator cavity filter to a radiating element of the phased array antenna, over a moderate bandwidth of approximately 6%, and attains a high flow of power with good coupling of a circularly polarized signal into the environment external to the radiating element. The invention is operative also, if desired, to provide such coupling of electromagnetic power between the filter and a waveguide, as well as from the filter directly into the external environment. The ring may be located at the opening of the cavity through which the power is coupled between the filter and the radiator or the waveguide or the empty space. It is to be noted also that, while the description of the invention herein is facilitated by reference to a transmission of power from the filter, it is to be understood that the principles of the invention apply equally to the reception of power by the filter.

BRIEF DESCRIPTION OF THE DRAWING

The aforementioned aspects and other features of the invention are explained in the following description, taken in connection with the accompanying drawing wherein:

FIGS. 2A and 2B show sectional fragmentary views of the filter and the radiator of FIG. 1 disclosing placement of the coupling ring in front of a resonator of the filter in accordance with different embodiments of the invention wherein FIG. 2A shows a placement of the ring directly on a front base surface of the resonator and FIG. 2B shows a spacing between the ring and the filter by an insulating disk of dielectric material;

Identically labeled elements appearing in different ones of the figures refer to the same element in the different figures but may not be referenced in the description for all figures.

DETAILED DESCRIPTION

Figure 1:
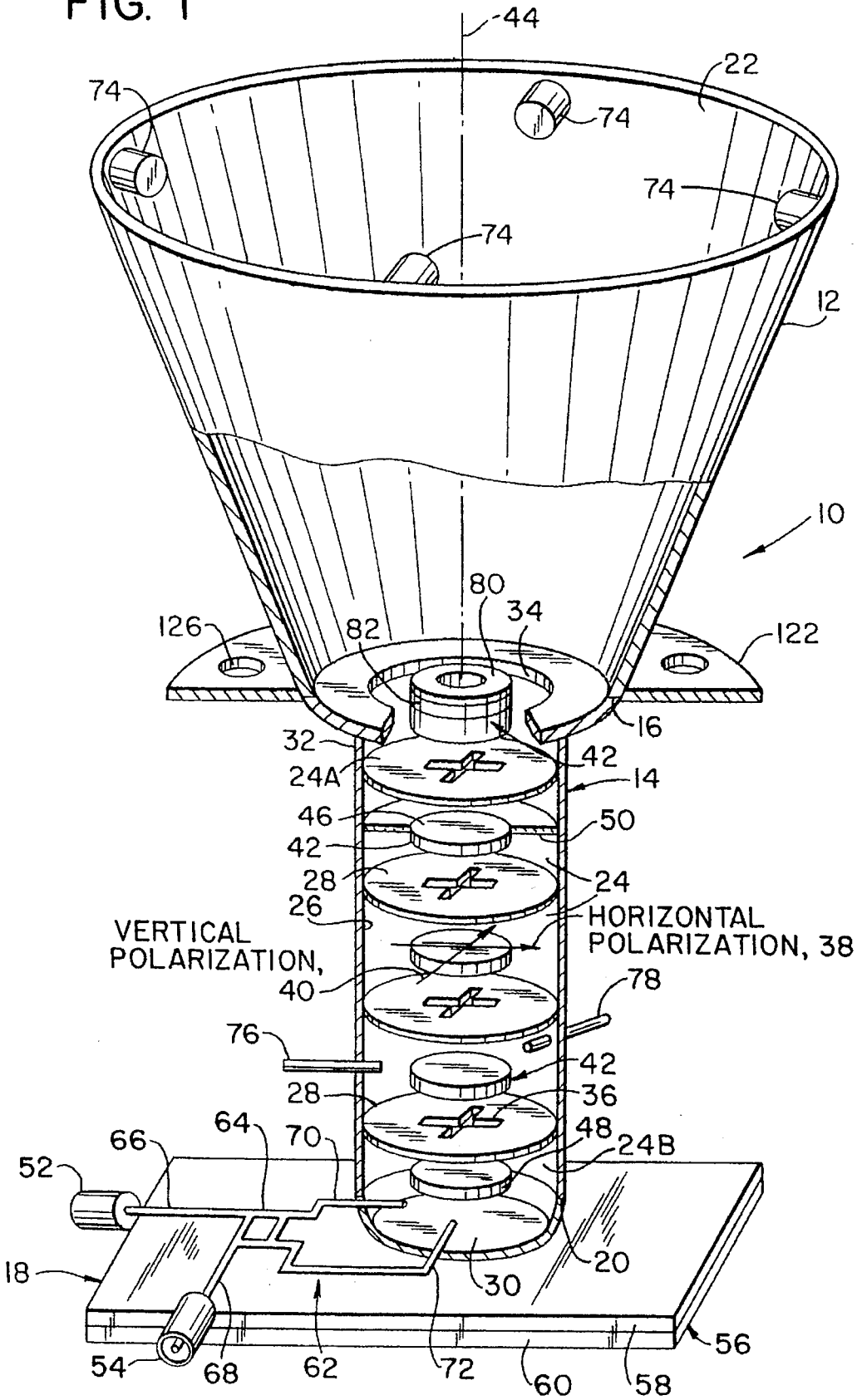
FIG. 1 shows a stylized side elevation view of a dielectric resonator filter coupled by an annular ring to a radiator in accordance with the invention, portions of the filter and the radiator being cut away to show interior details of the filter.

With reference to FIG. 1, there is shown a radiator assembly 10 comprising a radiator 12 in the form of a horn having a frustoconical shape with circular cross section. The radiator assembly 10 further comprises a filter 14 connecting with a back end 16 of the radiator 12, and a feed circuit 18 connecting with a back end 20 of the filter 14 for applying signals to the filter 14 to be radiated from a front radiating aperture 22 of the radiator 12 and for extracting signals from the filter 14 which have been received by the radiator 12. By way of example, the feed circuit 18 is constructed as a microstrip circuit, it being understood that other forms of feed circuits may be employed in the practice of the invention.

The filter 14 is a dual mode, dielectric resonator filter, and comprises a series of cavities 24 enclosed within a common sidewall 26 having an inner circular cylindrical surface, and wherein the cavities 24 are separated by transverse walls 28 supported by the sidewall 26. The back end 20 of the filter 14 is closed off by an end wall 30 and, at a front end 32 of the filter 14, a front cavity 24A opens via an opening 34 into the back end 16 of the radiator 12. Each of the transverse walls 28 is provided with an iris 36 for coupling of electromagnetic power between successive ones of the cavities 24. In order to couple horizontally polarized radiation, indicated by an arrow 38, and vertically polarized radiation, indicated by an arrow 40, independently of each other between the cavities 24, each of the irises 36 has a cruciform shape. The filter 14 further comprises a series of dielectric resonators 42 located within respective ones of the cavities 24 and positioned along a central axis 44 of the radiator assembly 10.

The resonators 42 are fabricated of a high dielectric ceramic material such as rutile, barium tetratitanate, or zirconium stannate. Each of the resonators 42 has front and back flat circular base surfaces 46 and a cylindrical side surface 48. Each base surface 46 is perpendicular to the central axis 44. The cavity walls are fabricated of an electrically conductive material, a suitable material being a metal such as aluminum, brass, or invar. Each resonator 42 may be held in its cavity 24 by means of a retainer 50 constructed as an annular ring of electrically insulating, low dielectric material wherein the dielectric constant of the retainer material is substantially less than the dielectric constant of the resonator 42. Only one of the retainers 50 is shown to simplify the drawing. In each cavity 24, the retainer 50 tightly encircles its resonator 42 and presses against the sidewall 26 to hold the resonator 42 in its position.

The filter 14 is well suited for satellite communication systems. Circularly polarized electromagnetic signals are preferred in satellite communications. It is well known that a circularly polarized signal, either left hand or right hand, can be resolved into two components, namely, vertical polarization and horizontal polarization, as indicated by the arrows 40 and 38. The filter 14, by virtue of its dual mode, dielectric resonator properties, provides the foregoing property of handling the circular polarization. In addition, this construction of the filter serves to minimize size and weight for compatibility with a satellite-borne phased array antenna. The filter 14 may be visualized as comprising two identical sub-filters sharing a common filter housing and sharing each dual mode resonator. A vertically polarized signal propagates through the filter using, for example, a vertical mode of the dual mode resonator. Similarly, a horizontally polarized signal propagates through the filter using, for example, a horizontal mode of the dual mode resonator. Since the pair of sub-filters shares the same dual mode dielectric loaded cavities, filter tracking over varying temperature is very good. The filter 14 is capable of receiving or transmitting circularly of linearly polarized signals. For the purpose of handling the circular polarization, cross coupling between the vertical and the horizontal modes is avoided, this resulting in a Chebyshev type response which is typical for wider band, preselect filters.

In order to provide the vertically and horizontally polarized waves within the filter 14, the feed circuit 18 comprises two input coaxial connectors 52 and 54 supported by a base 56 of the feed circuit 18. The base 56 is a laminated structure comprising a layer 58 of dielectric electrically insulating material, a metallic sheet serving as a ground plane 60 disposed on a back side of the layer 58, and a microstrip circuit 62 of metallic conductors deposited on a front surface of the layer 58. The microstrip circuit 62 includes a hybrid coupler 64 having a first input arm 66 extending to the connector 52, a second input arm 68 extending to the connector 54, a first output arm 70 extending in the direction of the horizontal polarization arrow 38 into a back cavity 24B to serve as a probe for coupling energy into the cavity, and a second output arm 72 extending in the direction of the vertical polarization arrow 40 into the back cavity 24 to serve as a probe for coupling energy into the cavity. The input connector 52 connects between the first input arm 66 and the ground plane 60. The second input connector 54 connects between the second input arm 68 and the ground plane 60. The back cavity 24B is recessed within the base 56 to permit entry of the output arms 70 and 72 via the sidewall 26 into the back cavity 24B.

The hybrid coupler 64 introduces a 90° phase shift between signals propagating on the two output arms 70 and 72 to provide the vertically and horizontally polarized signals within the filter 14 with time quadrature relative to each other. This produces a circularly polarized wave upon outputting of the two linearly polarized waves from the filter 14 into the radiator 12. The radiator 12 is provided with a set of four tuning posts 74 located within the radiator 12 at the front radiating aperture 22. The tuning posts 74 are located in perpendicular axial planes of the radiator assembly 10 parallel to the hybrid coupler output arms 70 and 72 and to the crossed arms of the irises 36. The tuning posts 74 aid in a precision forming of a circularly polarized wave from the radiator 12 and in reduction of mutual coupling between the radiator 12 and other radiators to be employed in the construction of an array of radiators 12, as will be described hereinafter.

Individual ones of the cavities 24 of the filter 14 may be provided also with screws to accomplish tuning and mode coupling if desired. By way of example, one such tuning screw 76 is shown extending through the sidewall 26, in the direction of the horizontal polarization arrow 38, into one of the cavities 24. A second such tuning screw, not shown, may be directed into the same cavity 24, in a direction parallel to the vertical polarization arrow 40. The two tuning screws in the cavity 24, as well as corresponding tuning screws (not shown) located at other ones of the cavities 24, allow for individual tuning of the filter 14 respectively to the horizontally polarized wave and to the vertically polarized wave.

In accordance with a feature of the invention, four mode coupling screws 78 (only one of which is shown to simplify the drawing) are provided for each cavity, the mode coupling screws 78 being oriented in perpendicular longitudinal planes of the radiator assembly 10 oriented at 45° to the planes of the vertical and horizontally polarized waves. As noted above, it is desired to operate the filter without interaction of the horizontally and the vertically polarized waves. However, in the construction of a filter, in view of limitations in mechanical tolerances of such construction, there may be a minimal amount of unintended cross coupling between the vertically and the horizontally polarized waves. The invention provides for a neutralization of the unintended coupling by selective application of a slight penetration of a mode coupling screw 78 within a cavity 24 having such unintended cross coupling. Thereby, there is significant enhancement of the purity of the circularly polarized wave transmitted by the radiator 12. In view of the reciprocal operation of the radiator assembly 10 to transmitted and received electromagnetic waves, the radiator assembly 10 is better able to distinguish between right and left circularly polarized waves received at an array antenna borne by a satellite in a satellite communications system. This enables the connectors 52 and 54 to receive signals of the separate right and left circularly polarized signal channels with greater clarity than has been available heretofore.

Figure 2A:
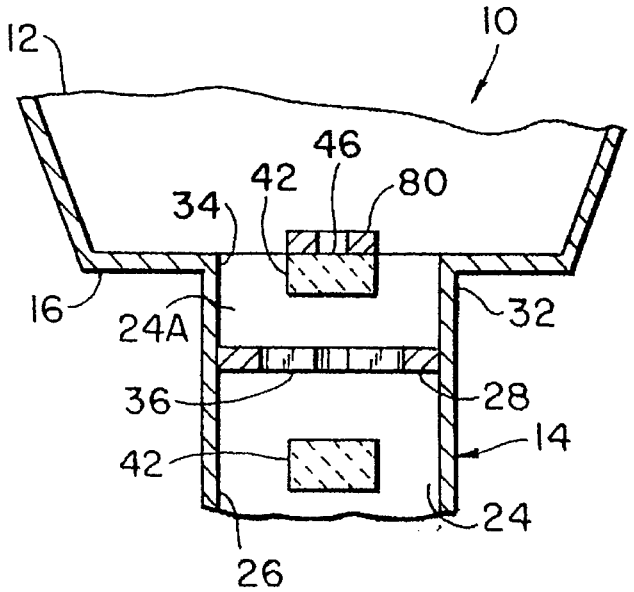
Figure 2B:
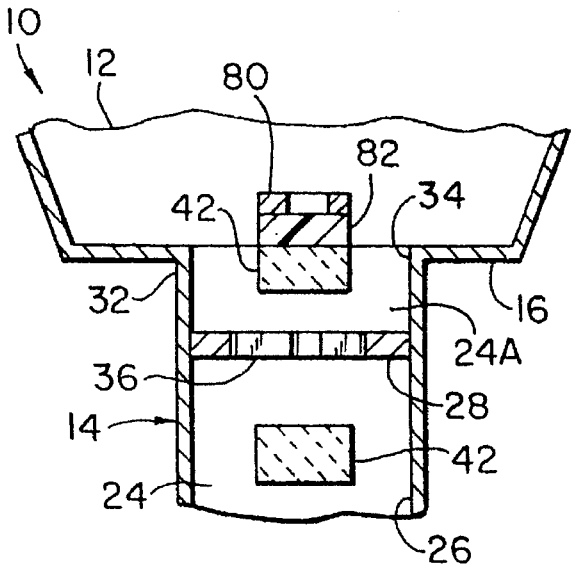

With reference to FIGS. 1, 2A and 2B, an important feature of the invention is provided by locating a coupling annular ring 80 in front of the resonator 42 of the front cavity 24A. The coupling ring 80 may be positioned directly on the front base surface 46 of the resonator 42, as shown in FIG. 2A, or spaced apart from the resonator 42 by an electrically insulating disc 82 of dielectric material as shown in FIGS. 1 and 2B. The disc 82 may be formed of plastic such as polystyrene having a dielectric constant much lower than that of the dielectric constant of the material of the resonator 42. The back end 16 of the radiator 12 extends, in the manner of a shelf, outwardly from the filter sidewall 26 in a plane transverse to the central axis 44 (see FIG. 1). The resonator 42 of the front cavity 24A may be located with its front base surface 46 at or approximately at the transverse plane of the radiator back end 16, and the ring 80 may be located forward of the transverse plane of the radiator back end 16. The location of the ring 80 may be optimized by experimental adjustment.

The thickness of the disc 82 is in a range, typically, of 1/20–1/2 of the thickness of the resonator 42 as measured along the axis 44. The thickness of the ring 80 is less than 1/10, and preferably less than 1/20, of a free-space wavelength of the radiation emitted by the radiator 12. In practice, the ring 80 is constructed by deposition of a thin sheet of metal, such as copper, having a thickness of approximately one mil. The diameters of the disc 82 and the resonator 42 are equal or approximately equal. The outer diameter of the ring 80 is approximately equal to that of the resonator 42, or may be slightly less, falling within the range of 90–100% of the diameter of the resonator 42. The inner diameter of the ring 80 has a magnitude approximately one-half that of the outer diameter of the ring 80. The coupling ring 80 is effective to provide for improved coupling of electromagnetic power through the opening 34 (see FIG. 1) at the front of the filter 14, minimizing reflected waves and providing a VSWR (voltage standing wave ratio) of close to unity.

Figure 3:
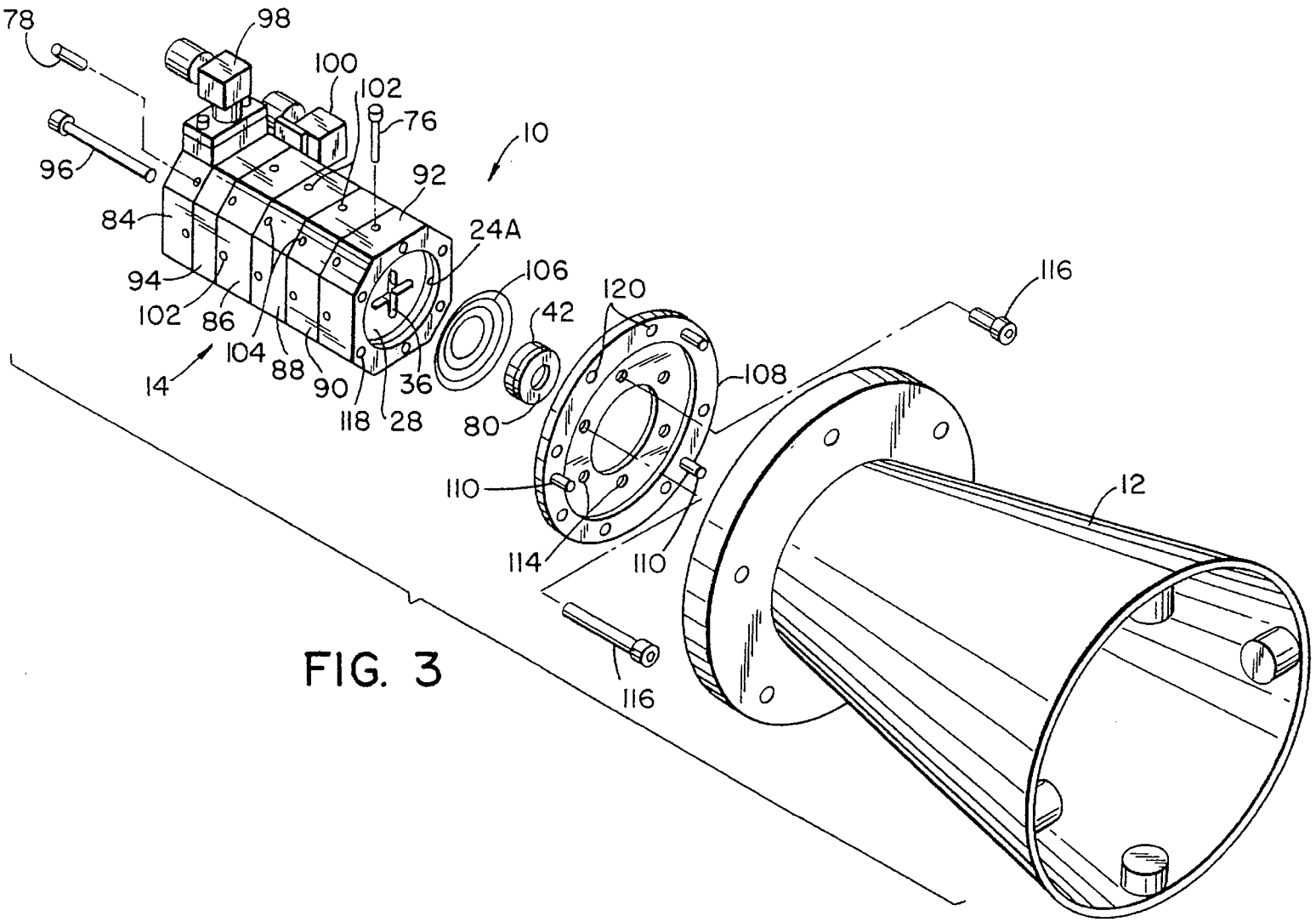
FIG. 3 is an exploded view of the filter and the resonator of FIG. 1.

FIG. 3 provides an example in a mode of construction of the radiator assembly 10 of FIG. 1. In FIG. 1, the filter 14 is shown as having five cavities 24 and five resonators 42, by way of example, it being understood that any number of cavities 24 and resonators 42 can be employed as may be desired. In FIG. 3, filter 14 includes a set of waveguide sections 84, 86, 88, 90, and 92, and an iris support 94 which are stacked, one upon the other, in the order shown in FIG. 3, and are bolted together by bolts 96, one of which is shown in FIG. 3. Connectors 98 and 100 function in an equivalent manner to the connectors 52 and 54 of FIG. 1, and are mounted to the back waveguide section 84. The iris support 94 is disposed between the waveguide sections 84 and 86. Each of the waveguide sections 84 and 86 also serve to form a sidewall of the cavities of the filter 14, the sidewall being functionally equivalent to the sidewall 26 of FIG. 1. Similarly, the waveguide sections 88, 90, and 92 also serve to form the sidewalls of cavities of the filter 14. The front waveguide section 92 supports a transverse wall 28 with a cruciform iris 36 therein, the transverse wall 28 serving as the back wall of the front cavity 24A. Additional ones of the transverse walls, not shown in FIG. 3, are understood to be supported by various ones of the waveguide sections 86, 88, and 90. The end wall 30, not shown in FIG. 3, is supported by the back waveguide section 84.

Also shown in FIG. 3 is a tuning screw 76 mounted within the front waveguide section 92. Numerous threaded bores 102 are provided for insertion of tuning screws such as the tuning screw 76 to interact with both horizontally and vertically polarized waves. Also provided are threaded bores 104 for receiving mode coupling screws 78, one of which is shown in FIG. 3. A retainer 106, constructed in a manner similar to the retainer 50 of FIG. 1, positions the resonator 42 relative to the front waveguide section 92. The coupling ring 80 is disposed on the front base surface of the resonator 42. A coupling plate 108 provides for connection of the radiator 12 to the front waveguide section 92. Adapter pins 110 of the plate 108 fit within apertures 112 (shown in FIG. 4) in the back end 16 of the radiator 12. An inner array of apertures 114 of the plate 108 receive screws 116 for connection of the coupling plate 108 to corresponding apertures 118 in a front face of the front waveguide section 92 for connection of the plate 108 to the filter 14. An outer array of apertures 120 of the coupling plate 108 allow the passage of screws (not shown) to the apertures 112 on the radiator back end 16 for connection of the radiator 12 to the plate 108. Thereby, the various components of the radiator assembly 10 are connected together to construct the radiator assembly 10.

Figure 4:
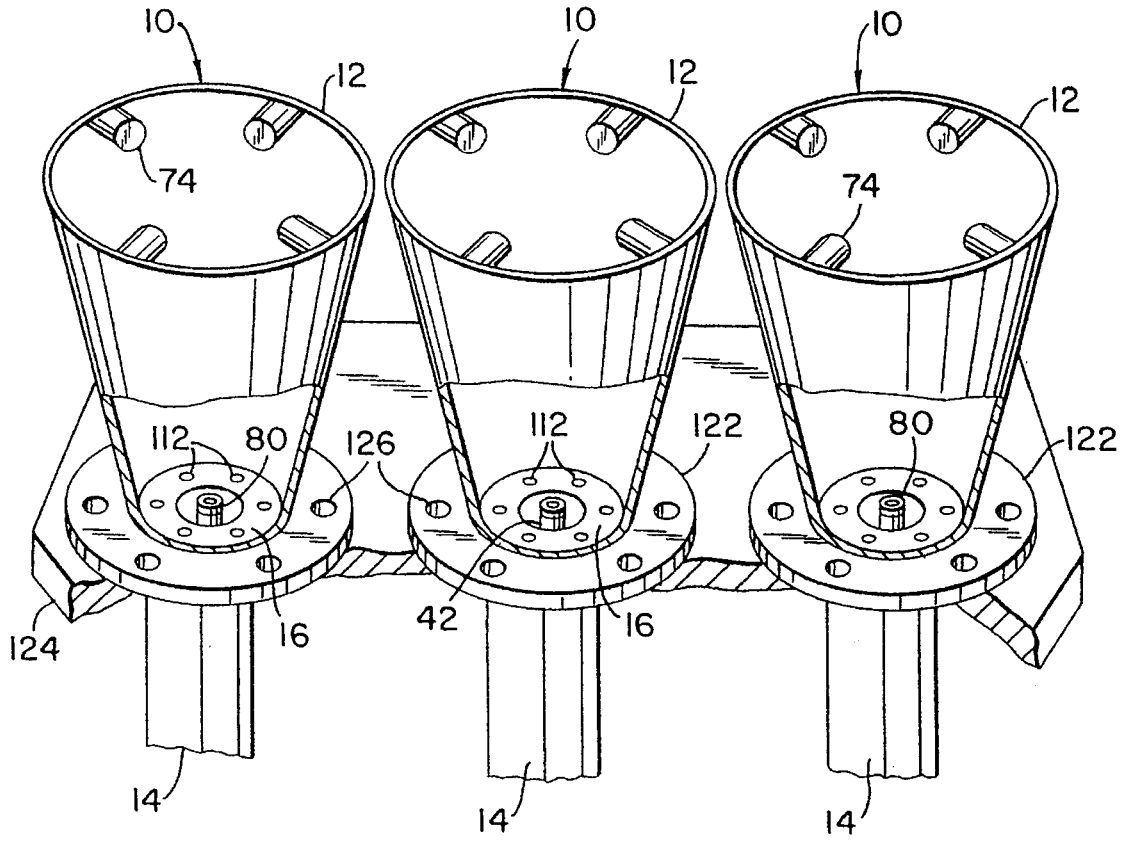
FIG. 4 shows a stylized fragmentary view of an array of radiator assemblies forming a portion of an array antenna wherein each of the radiator assemblies includes the filter and the radiator of FIG. 1.

FIG. 4 shows an array of three of the radiator assemblies 10 wherein each of the radiators 12 is provided with a mounting flange 122 extending radially outward of the back end 16 for engagement with a support plate 124. The mounting flanges 122 are provided with apertures 126 for receiving bolts (not shown) for securing the flanges 122 to the support plate 124. The flanges 122 are disposed on a front surface of the support plate 124, and the filters 14 extend through the support plate 124 to a location behind the support plate 124. Also shown in FIG. 4, in a cut-away portion of each of the radiators 12, is the coupling ring 80 for coupling power between the filter 14 and the radiator 12.

Figure 5:
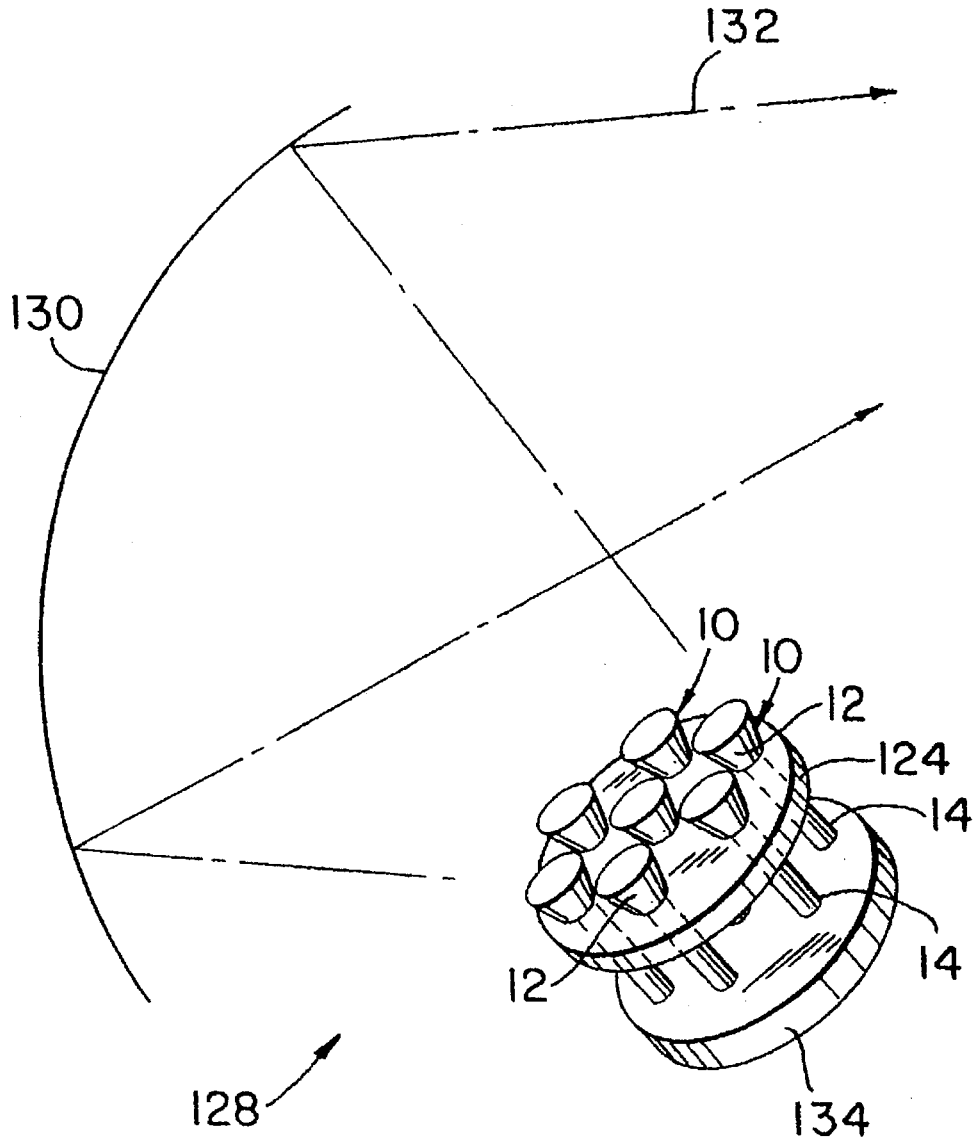
FIG. 5 is a diagrammatic view of a phased array antenna including an array of the radiator assemblies of FIG. 4.

FIG. 5 shows a phased array antenna 128 comprising an array of the radiator assemblies 10 supported on the support plate 124 wherein the radiators 12 face a reflector 130 of the antenna 128. The reflector 130 gathers rays of radiation emitted by the radiators 12 to form a beam 132 of the radiation. The filters 14 of each of the radiator assemblies 10 connect with a beamformer 134 which applies electric signals to the various filters 14 for generating the beam 132, the beamformer 134 including also circuitry for receiving signals incident upon the antenna 128 by the beam 132.

Figure 6:
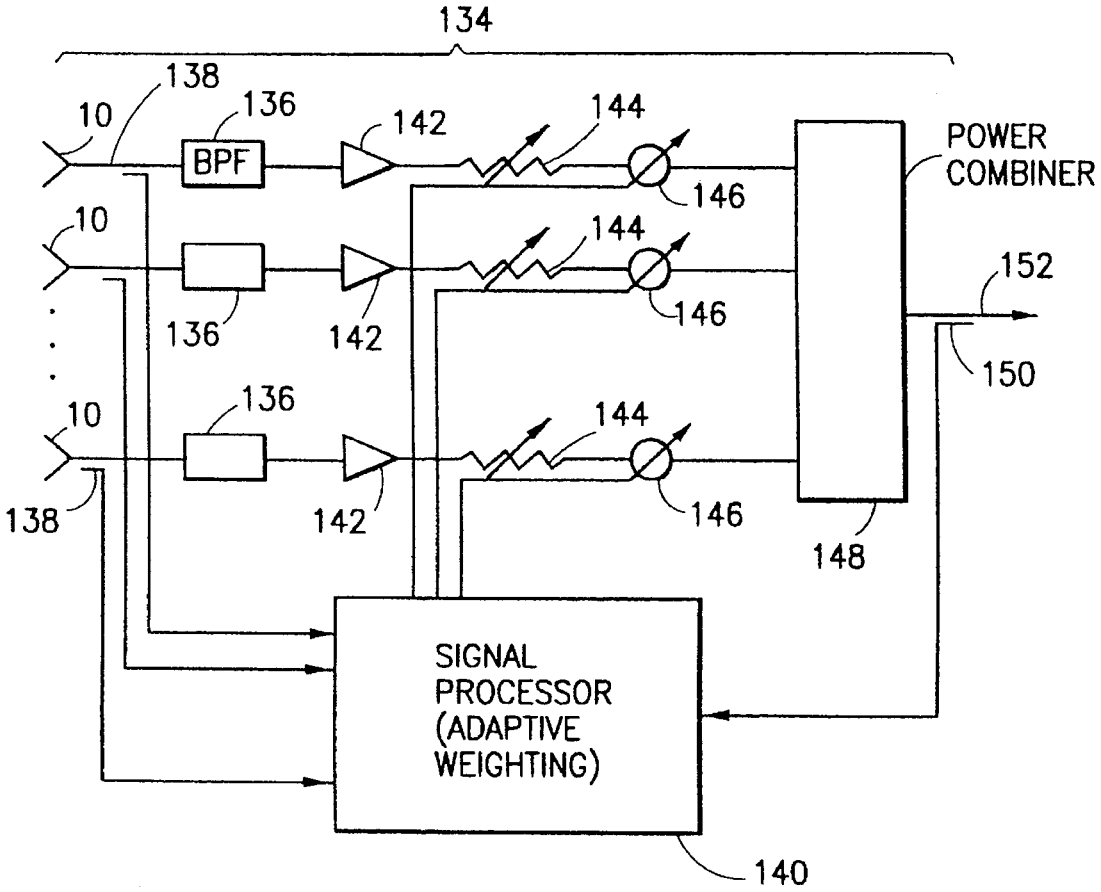
FIG. 6 shows diagrammatically microwave circuitry and a beamformer connected to the radiator assemblies of FIG. 5 for providing a received beam of radiation.

FIG. 6 shows electrical circuitry of the beamformer 134 connected to the array of radiator assemblies 10 of FIG. 5 for receiving signals incident upon the array of the radiator assemblies 10. The beamformer 134 comprises a set of band pass filters 136 connected to respective ones of the radiator assemblies 10, and a set of microwave couplers 138. The couplers 138 are connected between respective ones of the radiator assemblies 10 and their respective band pass filtes 136 for sampling a received signal, and for applying the samples of the received signals to a signal processor 140. The received signals, upon being filtered by the respective ones of the bandpass filters 136, are applied to low-noise amplifiers 142 to raise the signal power to a sufficient level for subsequent signal processing. The filters 136 aid in improving the signal-to-noise ratio of the signals in the respective signal channels. In each signal channel, the output signal from each of the amplifiers 142 is coupled via a variable attenuator 144 and a variable phase shifter 146 to a power combiner 148. Operation of each of the attenuators 144 and of each of the phase shifters 146 is controlled electronically by signals applied to the attenuators 144 and the phase shifters 146 by the signal processor 140.

The power combiner 148 is operative to sum together the signals of the respective signal channels, as outputted by each of the phase shifters 146. The combined signal of the combiner 148 is outputted via a power coupler 150 to appear on line 152 as output signal of the beamformer 134. The coupler 150 is operative to provide a sample of the signal outputted by the combiner 148 to the signal processor 140. The signal processor 140 is operative to compare the output signal sample to each of the input signal samples to provide for an adaptive weighting of the signals of the respective channels by operation of the attenuators 144 and the phase shifters 146. The attenuators 144 provide an amplitude taper to the signals received by the respective radiator assemblies 10, and the phase shifters 146 adjust the phases of the various signals to provide for a cophasal summation of the signals at the power combiner 148. Thereby, the beamformer 134 is operative to extract the received output signal in an optimal fashion from the signals applied to the respective radiator assemblies 10 of the antenna 128 of FIG. 5.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A filter for an electromagnetic signal, comprising:

a first cavity and a first dielectric resonator, said first resonator being located within said first cavity, said first cavity having a first end and a second end opposite said first end, said first cavity comprising an electrically conductive sidewall extending from said first end to said second end, said first cavity further comprising an electrically conductive end wall located at said first end connecting with said sidewall;

wherein said resonator has opposed front and back flat base surfaces and a cylindrical sidewall surface joining said base surfaces, said first resonator and said first cavity having respective dimensions which are operative with a wavelength of said signal to provide a filter characteristic to said first cavity;

said first cavity has an opening at said second end, said back base surface facing said end wall and said front base surface facing said opening; and said filter further comprises an annular ring disposed in front of said front base surface of said first resonator and extending through said opening to facilitate a coupling of power of said signal through said opening.

2. A filter according to claim 1 wherein said front base surface of said first resonator is circular, said ring is circular, and a diameter of said front base surface is equal to or greater than an outer diameter of said ring.

3. A filter according to claim 1 wherein said ring is spaced apart from said front base surface of said first resonator, and a disk of dielectric electrically insulating material is located between said first resonator and said ring, a dielectric constant of said disk being less than a dielectric constant of said first resonator.

4. A filter according to claim 1 further comprising coupling means disposed in front of the end wall of said first cavity for applying the electromagnetic signal to said first cavity to be radiated from the opening of said first cavity, wherein said coupling means comprises hybrid coupler means for introduction of vertically and horizontally polarized waves of said electromagnetic signal in time quadrature to provide a circular polarization to the electromagnetic signal transmitted from said opening.

5. A filter according to claim 1 further comprising a second cavity and a second dielectric resonator enclosed by said second cavity, said second cavity being contiguous said first end of said first cavity, there being an iris in said end wall of said first cavity for coupling the electromagnetic signal between said first and said second cavities.

6. A filter according to claim 5 wherein said second cavity has an end wall opposite the end wall of said first cavity, said filter further comprising coupling means disposed in front of the end wall of said second cavity for applying the electromagnetic signal to said second cavity such that said electromagnetic signal is coupled from said second cavity to said first cavity and then radiated from the opening of said first cavity.

7. A filter according to claim 6 wherein said coupling means comprises hybrid coupler means for introduction of vertically and horizontally polarized waves of said electromagnetic signal in time quadrature to provide a circular polarization to the electromagnetic signal transmitted from said opening.

8. A filter according to claim 1 wherein said ring comprises an electrically conductive material.

9. A filter according to claim 1 wherein said ring is contiguous said first base surface of said first resonator.

10. A filter for an electromagnetic signal, comprising:

a first cavity and a first dielectric resonator, said first resonator being located within said first cavity, said first cavity having a first end and a second end opposite said first end, said first cavity comprising an electrically conductive sidewall extending from said first end to said second end, said first cavity further comprising an electrically conductive end wall located at said first end connecting with said sidewall;

wherein said resonator has opposed front and back flat base surfaces and a cylindrical sidewall surface joining said base surfaces, said first resonator and said first cavity having respective dimensions which are operative with a wavelength of said signal to provide a filter characteristic to said first cavity;

said first cavity has an opening at said second end, said back base surface facing said end wall and said front base surface facing said opening;

said filter further comprises an annular ring disposed in front of said front base surface of said first resonator to facilitate a coupling of power of said signal through said opening;

wherein said front base surface of said first resonator is circular, said ring is circular, and a diameter of said front base surface is equal to or greater than an outer diameter of said ring; and an inner diameter of said ring is approximately one-half the outer diameter of said ring.

11. A filter according to claim 10 wherein said ring has a thickness less than approximately one-tenth of a free-space wavelength of the electromagnetic signal coupled through said opening.

12. A filter according to claim 10 wherein said ring has a thickness less than approximately one-twentieth of a free-space wavelength of the electromagnetic signal coupled through said opening.

13. A filter according to claim 10 wherein said ring comprises an electrically conductive material.

14. A filter according to claim 13 wherein said electrically conductive material of said ring is a metal.

15. An antenna system for an electromagnetic signal, comprising:

an array of radiators constituting an antenna, and a plurality of filters coupled electromagnetically to respective ones of said radiators;

wherein each of said filters comprises a first cavity and a first dielectric resonator, said first resonator being located within said first cavity, said first cavity having a first end and a second end opposite said first end, said first cavity comprising an electrically conductive sidewall extending from said first end to said second end, said first cavity further comprising an electrically conductive end wall located at said first end connecting with said sidewall;

wherein, in each of said filters, said resonator has opposed front and back flat base surfaces and a cylindrical sidewall surface joining said base surfaces, said first resonator and said first cavity having respective dimensions which are operative with a wavelength of said signal to provide a filter characteristic to said first cavity;

in each of said filters, said first cavity has an opening at said second end, said back base surface facing said end wall and said front base surface facing said opening;

each of said filters further comprises an annular ring disposed in front of said front base surface of said first resonator to facilitate a coupling of power of said signal through said opening;

each of said filters connects to the radiator corresponding therewith via said opening to accomplish coupling of the power of said electromagnetic signal between the filter and the radiator corresponding therewith;

in each of said filters, said front base surface of said first resonator is circular, said ring is circular, and a diameter of said front base surface is equal to or greater than an outer diameter of said ring; and in each of said filters, an inner diameter of said ring is approximately one-half the outer diameter of said ring.

16. A system according to claim 15 wherein, in each of said filters, said ring has a thickness less than approximately one-twentieth of a free-space wavelength of the electromagnetic signal coupled through said opening, said ring comprising an electrically conductive material.

17. An antenna system for a electromagnetic signal, comprising:

an array of radiators constituting an antenna, and a plurality of filters coupled electromagnetically to respective ones of said radiators;

wherein each of said filters comprises a first cavity and a first dielectric resonator, said first resonator being located within said first cavity, said first cavity having a first end and a second end opposite said first end, said first cavity comprising an electrically conductive sidewall extending from said first end to said second end, said first cavity further comprising an electrically conductive end wall located at said first end connecting with said sidewall;

wherein, in each of said filters, said resonator has opposed front and back flat base surfaces and a cylindrical sidewall surface joining said base surfaces, said first resonator and said first cavity having respective dimensions which are operative with a wavelength of said signal to provide a filter characteristic to said first cavity;

in each of said filters, said first cavity has an opening at said second end, said back base surface facing said end wall and said front base surface facing said opening; and each of said filters further comprises an annular ring disposed in front of said front base surface of said first resonator and extending through said opening to facilitate a coupling of power of said signal through said opening; and wherein each of said filters connects to the radiator corresponding therewith via said opening to accomplish a coupling of the power of said electromagnetic signal between the filter and the radiator corresponding therewith.

18. A system according to claim 17 wherein, in each of said filters, said front base surface of said first resonator is circular, said ring is circular, and a diameter of said front base surface is equal to or greater than an outer diameter of said ring.

19. A system according to claim 17 wherein in each of said filters, said ring is contiguous said front base surface of said first resonator.

20. A system according to claim 17 wherein in each of said filters, said ring is spaced apart from said front base surface of said first resonator, and a disk of dielectric electrically insulating material is located between said first resonator and said ring, a dielectric constant of said disk being less than a dielectric constant of said first resonator.

21. A system according to claim 17 wherein in each of said filters, said ring comprises an electrically conductive material, and each of said filters further comprises a second cavity and a second dielectric resonator enclosed by said second cavity, said second cavity being contiguous said first end of said first cavity, there being an iris in said end wall of said first cavity for coupling the electromagnetic signal between said first and said second cavities.

22. A system according to claim 21 wherein, in each of said filters, said second cavity has an end wall opposite the end wall of said first cavity, said filter further comprising coupling means disposed in front of the end wall of said second cavity for applying the electromagnetic signal to said second cavity such that said electromagnetic signal is coupled from said second cavity to said first cavity and then radiated from the opening of said first cavity.

23. A system according to claim 22 wherein, in each of said filters, said coupling means comprises hybrid coupler means for introduction of vertically and horizontally polarized waves of said electromagnetic signal in time quadrature to provide a circular polarization to the electromagnetic signal transmitted from said opening.

24. A system according to claim 23 further comprising a beamformer connected to the hybrid coupler of each of said filters for combining radiation transmitted by each of said radiators into a beam of radiation for said antenna.

25. A system according to claim 17 further comprising, for each of said plurality of filters, coupling means disposed in front of the end wall of said first cavity of a filter for applying the electromagnetic signal to said first cavity to be radiated from the opening of said first cavity, wherein said coupling means comprises hybrid coupler means for introduction of vertically and horizontally polarized waves of said electromagnetic signal in time quadrature to provide a circular polarization to the electromagnetic signal transmitted from said opening.

26. A filter for an electromagnetic signal, comprising:

a first cavity and a first dielectric resonator, said first resonator being located within said first cavity, said first cavity having a first end and a second end opposite said first end, said first cavity comprising an electrically conductive sidewall extending from said first end to said second end, said first cavity further comprising an electrically conductive end wall located at said first end connecting with said sidewall;

wherein said resonator has opposed front and back flat base surfaces and a cylindrical sidewall surface joining said base surfaces, said first resonator and said first cavity having respective dimensions which are operative with a wavelength of said signal to provide a filter characteristic to said first cavity;

said first cavity has an opening at said second end, said back base surface facing said end wall and said front base surface being contiguous to said opening; and said filter further comprises an annular ring disposed in front of said front base surface of said first resonator to facilitate a coupling of power of said signal through said opening.

27. A filter for an electromagnetic signal, comprising:

a first cavity and a first dielectric resonator, said first resonator being located within said first cavity, said first cavity having a first end and a second end opposite said first end, said first cavity comprising an electrically conductive sidewall extending from said first end to said second end, said first cavity further comprising an electrically conductive end wall located at said first end connecting with said sidewall;

wherein said resonator has opposed front and back flat base surfaces and a cylindrical sidewall surface joining said base surfaces, said first resonator and said first cavity having respective dimensions which are operative with a wavelength of said signal to provide a filter characteristic to said first cavity;

said first cavity has an opening at said second end, said back base surface facing said end wall and said front base surface facing said opening;

said filter further comprises an annular ring disposed in front of said front base surface of said first resonator to facilitate a coupling of power of said signal through said opening; and said ring is spaced apart from said front base surface of said first resonator, and a disk of dielectric electrically insulating material is located between said first resonator and said ring, said disk extending through said opening, and a dielectric constant of said disk being less than a dielectric constant of said first resonator.

28. An antenna system for an electromagnetic signal, comprising:

an array of radiators constituting an antenna, and a plurality of filters coupled electromagnetically to respective ones of said radiators;

wherein each of said filters comprises a first cavity and a first dielectric resonator, said first resonator being located within said first cavity, said first cavity having a first end and a second end opposite said first end, said first cavity comprising an electrically conductive sidewall extending from said first end to said second end, said first cavity further comprising an electrically conductive end wall located at said first end connecting with said sidewall;

in each of said filters, said resonator has opposed front and back flat base surfaces and a cylindrical sidewall surface joining said base surfaces, said first resonator and said first cavity having respective dimensions which are operative with a wavelength of said signal to provide a filter characteristic to said first cavity;

in each of said filters, said first cavity has an opening at said second end, said back base surface facing said end wall and said front base surface being contiguous to said opening;

each of said filters further comprises an annular ring disposed in front of said front base surface of said first resonator to facilitate a coupling of power of said signal through said opening; and each of said filters connects to the radiator corresponding therewith via said opening to accomplish a coupling of the power of said electromagnetic signal between the filter and the radiator corresponding therewith.

29. An antenna system for an electromagnetic signal, comprising:

an array of radiators constituting an antenna, and a plurality of filters coupled electromagnetically to respective ones of said radiators;

wherein each of said filters comprises a first cavity and a first dielectric resonator, said first resonator being located within said first cavity, said first cavity having a first end and a second end opposite said first end, said first cavity comprising an electrically conductive sidewall extending from said first end to said second end, said first cavity further comprising an electrically conductive end wall located at said first end connecting with said sidewall;

in each of said filters, said resonator has opposed front and back flat base surfaces and a cylindrical sidewall surface joining said base surfaces, said first resonator and said first cavity having respective dimensions which are operative with a wavelength of said signal to provide a filter characteristic to said first cavity;

in each of said filters, said first cavity has an opening at said second end, said back base surface facing said end wall and said front base surface facing said opening;

each of said filters further comprises an annular ring disposed in front of said front base surface of said first resonator to facilitate a coupling of power of said signal through said opening;

in each of said filters, said ring is spaced apart from said front base surface of said first resonator, and a disk of dielectric electrically insulating material is located between said first resonator and said ring, said disk extending through said opening, and a dielectric constant of said disk being less than a dielectric constant of said first resonator; and each of said filters connects to its respective radiator via said opening to accomplish coupling of the power of said electromagnetic signal between the filter and its respective radiator.

* * * * *